US006591847B1

(12) United States Patent
Hurskainen

(10) Patent No.: US 6,591,847 B1
(45) Date of Patent: Jul. 15, 2003

(54) ARRANGEMENT FOR A PROCESS WASHING APPARATUS

(76) Inventor: Aarne Hurskainen, Peiponkuja 9, FIN-37600 Valkeakoski (FI)

( * ) Notice: Subject to any disclaimer, the term of this patent is extended or adjusted under 35 U.S.C. 154(b) by 0 days.

(21) Appl. No.: 09/806,772

(22) PCT Filed: Sep. 14, 1999

(86) PCT No.: PCT/FI99/00747

§ 371 (c)(1),
(2), (4) Date: Apr. 4, 2001

(87) PCT Pub. No.: WO00/20136

PCT Pub. Date: Apr. 13, 2000

(30) Foreign Application Priority Data

Oct. 5, 1998 (FI) ..... 982149

(51) Int. Cl.[7] ..... B08B 3/02

(52) U.S. Cl. ..... 134/167 R; 134/166 R; 134/168 R; 134/182

(58) Field of Search ..... 134/166 R, 169 R, 134/167 R, 168 R, 170, 182, 169 C, 138, 140, 141

(56) References Cited

U.S. PATENT DOCUMENTS

| | | | | |
|---|---|---|---|---|
| 2,658,623 | A | * | 11/1953 | Thronhill |
| 3,001,534 | A | * | 9/1961 | Grant, Jr. |
| 3,139,100 | A | * | 6/1964 | Griparis |
| 3,472,451 | A | * | 10/1969 | Orem et al. |
| 3,791,583 | A | * | 2/1974 | Nunlist et al. |
| 3,874,594 | A | * | 4/1975 | Hatley |
| 4,407,678 | A | * | 10/1983 | Furness et al. |
| 5,056,716 | A | * | 10/1991 | Robinson |
| 5,351,885 | A | * | 10/1994 | Manabe |
| 5,715,852 | A | * | 2/1998 | Jepsen |
| 5,871,023 | A | * | 2/1999 | Sherman, Jr. et al. |
| 5,896,871 | A | * | 4/1999 | Larsen |
| 6,021,793 | A | * | 2/2000 | Moulder |
| 6,039,056 | A | * | 3/2000 | Verbeek |

FOREIGN PATENT DOCUMENTS

| | | | |
|---|---|---|---|
| DE | 1807812 | * | 5/1968 |
| DE | 2 322 856 | | 11/1973 |
| FR | 2310165 | * | 12/1976 |
| GB | 2 311 475 A | | 10/1997 |

* cited by examiner

*Primary Examiner*—Frankie L. Stinson
(74) *Attorney, Agent, or Firm*—Connolly Bove Lodge & Hutz LLP

(57) ABSTRACT

The invention relates to an arrangement for a process washing apparatus, whereby a process device is washable by means of the apparatus by means of a washing device, that moves inside the same. The washing device (1) is connected moveably in connection with the process device by means of fastening means (2) and the washing medium of the washing device is arranged to be led at least partly inside the body (1*a*) of the washing device in order to spray the washing medium by nozzles (1*b*) or like existing in the body (1*a*) of the washing device. The washing device is arranged to be used by means of a driving device (K), such as a running motor (K1) and gear (K2) or a like. The arrangement comprises protecting means (SE) in order to protect the driving device (K) from its surroundings by a casing structure covering the same essentially overall.

21 Claims, 2 Drawing Sheets

ARRANGEMENT FOR A PROCESS WASHING APPARATUS

Figure 1B:
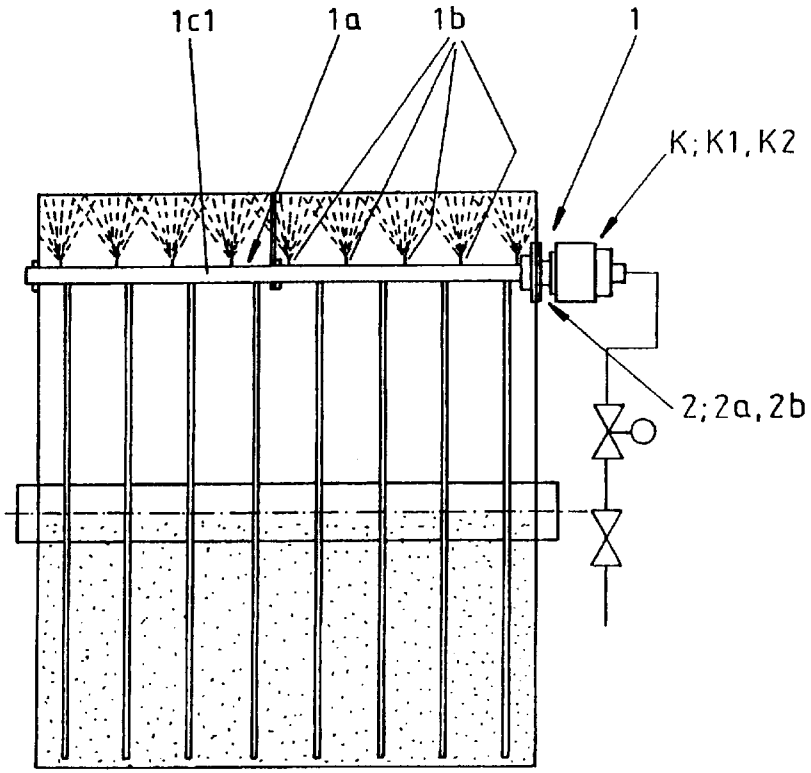
FIG.1b Prior art

The invention relates to an arrangement for a process washing apparatus, whereby a process device is washable by means of the apparatus by means of the washing device, that moves inside the same. The washing device is connected moveably in connection with the process device by means of fastening means and the washing medium of the washing device is arranged to be led at least partly inside the body of the washing device in order to spray the washing medium by nozzles or like existing in the body of the washing device. The washing device is arranged to be used by means of a driving device, such as a running motor and gear or a like.

It is nowadays known to use washing devices for process washing, in which the supply assembly for the washing medium is being led totally through the washing device, such as through its body and at least partly inside the fastening means connecting the same to the process device, such as an attachment frame fastened e.g. with screws, and also e.g. partly inside a running motor and gear acting as the driving device. Furthermore depending on the process device, the washing device comprises e.g. according to FIGS. 1*a* and 1*b* a body, that rotates around an axis, that is essentially perpendicular to its longitudinal axis, or, that rotates essentially around its longitudinal axis, which body is equipped with nozzles in order to direct the washing medium being led through the same to the surfaces to be washed of the process device. For the purpose described above it is known to use most heterogeneous washers, the operating principle of which is to act by influence of the pressure or flow of the washing liquid or, that are as described above moveable by external power.

One crucial problem involved with present device techniques in connection with the above in practice is such, that particularly the driving device of the washing device may get dirty. This is due to the fact, that the washing device is always situated in surroundings, that are very much exposed to getting dirty, that is why e.g. covering of the driving device by a shelter covering the same only from above, is not able to protect the driving device and other equipment being connected to the same effectively enough in practice. Many kinds of problems are caused by the above in practice, the most important of which worth mentioning are difficulty of service and maintenance and naturally also those risks caused for the reliability of the driving device, particularly in such a case, that the driving device is not being cleaned carefully and often enough.

It is the aim of the present arrangement according to the invention, to achieve a decisive improvement in the problems described above and thus to raise essentially the level of prior art. In order to carry out this aim, the arrangement according to the invention is primarily characterized by, that the arrangement comprises protecting means to protect the driving device from its surroundings by means of a casing structure covering the same essentially overall.

As the most important advantages of the arrangement according to the invention, may be mentioned the simplicity and reliability of the structures, that may be applied for the same, whereby the optimum operating of the driving device may get maximized under all kinds of circumstances and in all kinds of environments. In this case it is also possible to minimize the service and maintenance costs, because the driving device itself does not bring out service and maintenance needs, that are typical in nowadays practice.

When the arrangement according to the invention is being advantageously applied, it is possible to equip the casing structure covering the driving device from all over e.g. with a sight glass or to form one or several walls of the same of plexiglass. In this case it is possible to minimize furthermore the need for regular service and maintenance measures by monitoring carried out visually. Furthermore as an advantageous embodiment, inside the casing structure there has been arranged a flow of air carried out e.g. by compressed air, thanks to which it is furthermore possible to keep the internal conditions of casing structure optimum, that is as dry as possible.

Figure 1A:
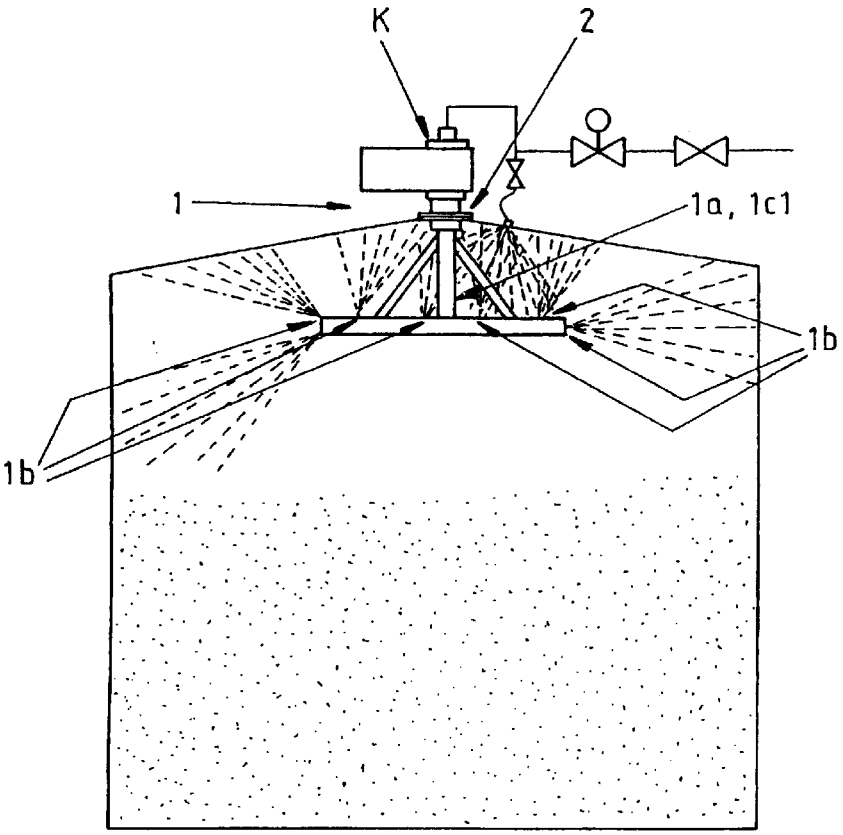
FIG.1a Prior art
Figure 2:
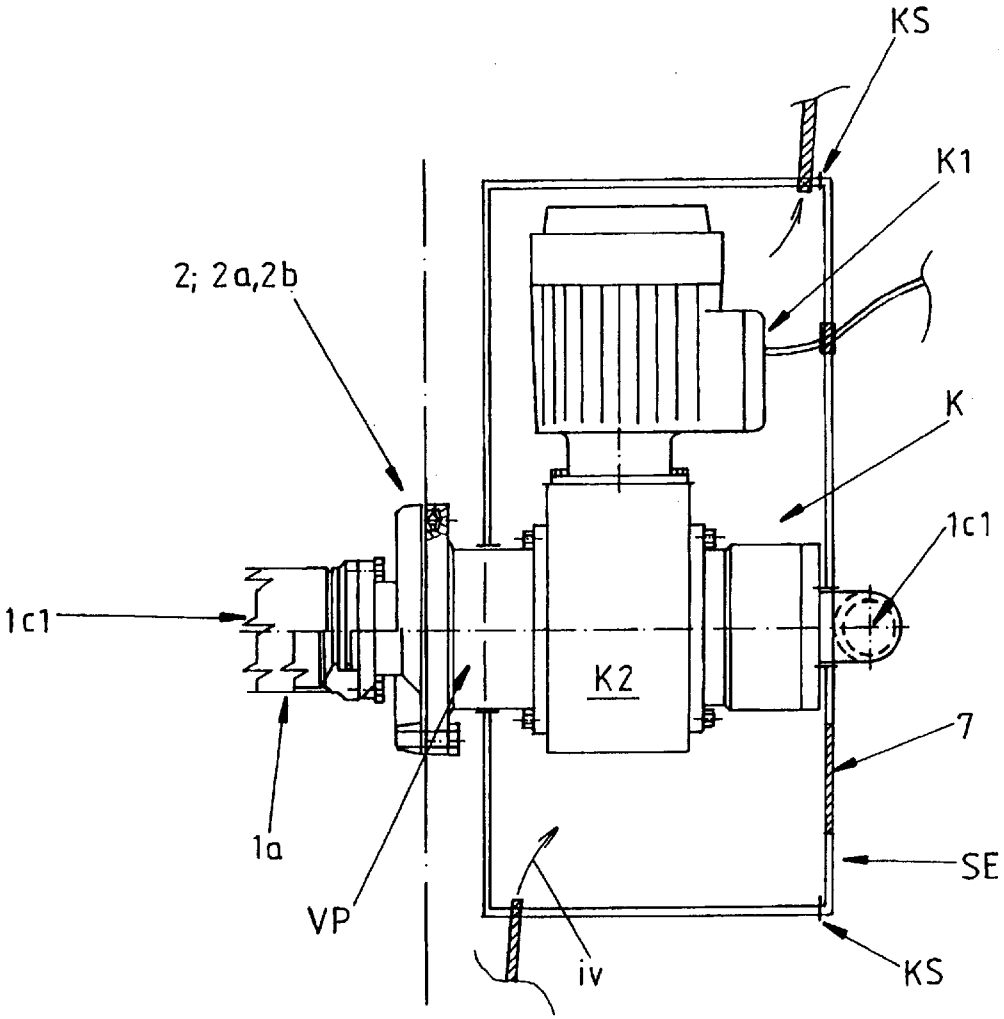

In the following description the invention is described in detail with reference to the appended drawings, in which FIGS. 1*a* and 1*b* show some usual washing devices used for process washing, FIG. 2 shows an advantageous embodiment of the apparatus according to the invention.

The invention relates to an arrangement for a process washing apparatus, whereby a process device is washable by means of the apparatus by means of a washing device, that moves inside the same. The washing device 1 is connected moveably in connection with the process device by means of fastening means 2 and the washing medium of the washing device is arranged to be led at least partly inside the body 1*a* of the washing device in order to spray the washing medium by nozzles 1*b* or like existing in the body 1*a* of the washing device. The washing device is arranged to be used by means of a driving device K, such as a running motor K1 and gear K2 or a like. The arrangement comprises protecting means SE in order to protect the driving device K from its surroundings by a casing structure covering the same essentially overall.

As an advantageous embodiment in practice of the invention, at least one supply assembly 1*c*1 for the washing medium is led totally through the washing device, such as inside its body 1*a* and at least partly inside the fastening means 2, such as an attachment frame 2*b* fastened with screws 2*a* or like, connecting the same to the process device, and inside the driving device K, such as the running motor K1 and the gear K2 or like. The casing structure SE surrounding the driving device K is arranged essentially air and water tight by arranging fittings equipped with sealing means to the same, in order to lead at least washing medium through the same as well as for the power transmitting end VP of the driving device and current supply of the running motor K1.

Furthermore as an advantageous embodiment the casing structure SE is arranged air conditioned by arranging an air flow iv carried out by compressed air or correspondingly to pass through the same.

Furthermore as an advantageous embodiment, to the casing structure there has been arranged monitoring means 7, such as a sightglass, probes or like, in order to monitor the internal space of the casing structure SE.

In this connection it is also possible to construct the casing structure SE in such way, that one or several walls of the same is formed of transparent material, such as made of plexiglass, glass or like.

Furthermore with reference to the advantageous embodiment shown in FIG. 2, one or several openable walls of the casing structure SE or a part of the same is/are connected to other parts of the structure advantageously by means of quick-release principle, such as by a two-ended threading, a tightening latch KS or correspondingly.

It is obvious, that the invention is not limited to the embodiments described or presented above, but it can be modified even to a great extent within the basic idea of the invention. Thus it is naturally clear, that the arrangement according to the invention may be applied in connection with a washing device, that is moveable in any possible way so, that the embodiments shown above are intended only to show certain common ways based on traditional washing device structures to carry out the invention.

What is claimed is:

1. A process washing apparatus for a process device, said process washing apparatus comprising:

a washing device that moves inside the process device, wherein the washing device is moveably connected to the process device by fastening means in order to spray a washing medium to a target by means of nozzles disposed in a body of the washing device, and wherein the washing device is driven by a driving device including a running motor and gear;

a protecting means to protect the driving device from surroundings, wherein said protecting means includes a casing structure covering the driving device, wherein said casing structure includes fittings equipped with sealing means that render the casing structure essentially air and water tight, wherein the washing medium, a power transmitting end of the driving device and a current supply of the running motor are led through the casing structure, and wherein the casing structure is air-conditioned by an air flow generated by compressed air and passing through the casing structure;

at least one supply assembly for the washing medium, wherein said at least one supply assembly is led totally through the washing device, including inside the body, at least partly inside a fastening means, and inside the driving device including the running motor and the gear, wherein said fastening means includes an attachment frame fastened with screws and connecting the washing device to the process device.

2. The apparatus according to claim 1, wherein a monitoring means is arranged to the casing structure to permit monitoring of internal space of the casing structure.

3. The apparatus according to claim 2, wherein the casing structure comprises at least one wall formed of transparent material selected from one of the following materials: glass and plexiglass.

4. The apparatus according to claim 3, wherein the casing structure comprises at least one openable wall arranged to be attached to other parts of the structure by means of a quick-release principle.

5. The apparatus according to claim 4, wherein the quick-release principle is selected from one of the following: a two-ended threading and a tightening latch.

6. The apparatus according to claim 3, wherein a part of the casing structure is arranged to be attached to other parts of the structure by means of a quick-release principle.

7. The apparatus according to claim 6, wherein the quick-release principle is selected from one of the following: a two-ended threading and a tightening latch.

8. The apparatus according to claim 2, wherein the casing structure comprises at least one openable wall arranged to be attached to other parts of the structure by means of a quick-release principle.

9. The apparatus according to claim 8, wherein the quick-release principle is selected from one of the following: a two-ended threading and a tightening latch.

10. The apparatus according to claim 2, wherein a part of the casing structure is arranged to be attached to other parts of the structure by means of a quick-release principle.

11. The apparatus according to claim 10, wherein the quick-release principle is selected from one of the following: a two-ended threading and a tightening latch.

12. The apparatus according to claim 2, wherein the monitoring means comprises at least one of the following: a sight glass and a probe.

13. The apparatus according to claim 1, wherein the casing structure comprises at least one wall formed of transparent material selected from one of the following materials: glass and plexiglass.

14. The apparatus according to claim 13, wherein the casing structure comprises at least one openable wall arranged to be attached to other parts of the structure by means of a quick-release principle.

15. The apparatus according to claim 14, wherein the quick-release principle is selected from one of the following: a two-ended threading and a tightening latch.

16. The apparatus according to claim 13, wherein a part of the casing structure is arranged to be attached to other parts of the structure by means of a quick-release principle.

17. The apparatus according to claim 16, wherein the quick-release principle is selected from one of the following: a two-ended threading and a tightening latch.

18. The apparatus according to claim 1, wherein the casing structure comprises at least one openable wall arranged to be attached to other parts of the structure by means of a quick-release principle.

19. The apparatus according to claim 18, wherein the quick-release principle is selected from one of the following: a two-ended threading and a tightening latch.

20. The apparatus according to claim 1, wherein a part of the casing structure is arranged to be attached to other parts of the structure by means of a quick-release principle.

21. The apparatus according to claim 20, wherein the quick-release principle is selected from one of the following: a two-ended threading and a tightening latch.

* * * * *